United States Patent [19]

Cheylus

[11] 4,331,064

[45] May 25, 1982

[54] PRESSURIZED FLUID MECHANISM SUCH AS A HYDRAULIC ENGINE

[75] Inventor: Jean-Francois Cheylus, Compiegne, France

[73] Assignee: Poclain Hydraulics, Verberie, France

[21] Appl. No.: 118,752

[22] Filed: Feb. 4, 1980

[30] Foreign Application Priority Data

Mar. 6, 1979 [FR] France ..... 79 05771

[51] Int. Cl.[3] ..... F01B 13/06

[52] U.S. Cl. ..... 92/58; 92/148; 92/165 R

[58] Field of Search ..... 92/58, 12.1, 72, 148, 92/153, 158, 160, 162, 165 R; 91/491

[56] References Cited

U.S. PATENT DOCUMENTS

| | | | |
|---|---|---|---|
| 1,916,978 | 7/1933 | Harper, Jr. | 92/160 |
| 2,324,291 | 7/1943 | Dodge | 92/148 |
| 3,659,504 | 5/1972 | Zürcher | 92/162 |
| 3,808,659 | 5/1974 | Alger, Jr. | 92/169 |
| 3,839,946 | 10/1974 | Paget | 92/170 |

FOREIGN PATENT DOCUMENTS

| | | |
|---|---|---|
| 500365 | 6/1919 | France . |
| 976857 | 10/1948 | France . |
| 2354459 | 1/1978 | France . |

OTHER PUBLICATIONS

Association Fransaise de Normalisation NF E05-015, Dec. 1972.

*Primary Examiner*—Abraham Hershkovitz
*Attorney, Agent, or Firm*—K. H. Boswell; Edward D. O'Brian

[57] ABSTRACT

The invention relates to a hydraulic engine with radial pistons, comprising girders which transmit the thrusts of the pistons and rest against strips secured to the cylinder block.

The surface of the cylinder block has a degree of roughness at least equal to the following values given in reference to the currently applied norms 0.25 μRA; 15 μRt; and 8 μRp.

The invention finds its application in the production of a reliable engine.

6 Claims, 6 Drawing Figures

PRESSURIZED FLUID MECHANISM SUCH AS A HYDRAULIC ENGINE

Radial piston mechanisms are known, which are driven under the effect of the pressure of a pressurized fluid. In this way, certain hydraulic engines have their rotor driven in rotation by the effect of the reaction created by the contact of the pistons on a cam. The thrust of the piston is transmitted to runners on the cam by way of a girder at each of the two ends of which is positioned one of said runners. Said girder is itself supported by the walls of a cut made in the cylinder block.

In order to facilitate the sliding of the girder in the cut, a strip of bronze is preferably inserted between the wall of the cut and the girder. A known arrangement is to fix the strip on the wall of the cut. However, considering the forces exerted during functioning, and considering in the case of hydraulic engines, the presence of hydraulic oil, the fixing of the said strip remains a difficult problem to solve. All of the known solutions call on a very accurate machining of the contacting surfaces, with in some cases, the addition of special arrangements such as appendages for wedging the strips. Although expensive, these solutions have yet to offer the efficiency required.

It is the aim of the invention to overcome the disadvantage of both costs and unreliability, by proposing an arrangement which is altogether simple and inexpensive and presents the required efficiency.

The invention therefore relates to a pressurized fluid mechanism, such as a hydraulic engine, with radial pistons, comprising:

- a cam,
- a cylinder block mounted for rotation, with respect to the said cam, about a rotation axis,
- at least one piston, mounted for axial sliding in a cylinder provided in the cylinder block, and,
- a girder;
  - which is coupled to said piston,
  - by means of which the said piston rests on the cam,
  - which is slidably mounted inside a radial cut provided in the cylinder block in extension of the said cylinder, and,
  - which rests against the walls of the cut parallel to the axis of the cylinder, with interposition of a removable strip, placed against each wall of the cut and the portion of girder facing it, and is fixed on one of the two parts-cylinder block and girder.

The surface of at least one of the two elements—wall of the part on which is fixed the strip and face of said strip which faces the said wall—has a degree of roughness which is at least equal to the following values given in reference to the currently enforced norms:

0.25 $\mu$Ra
15 $\mu$Rt
8 $\mu$Rp, wherein Ra is the mean arithmetic difference with respect to the mean line of roughness, Rt is the total depth of roughness and Rp is the roughness smoothing depth.

Furthermore, the following advantageous dispositions are preferably adopted:

- the said roughness is at least equal to 0.32 $\mu$Ra and can vary, on the one hand, between 20 and 30 $\mu$Rt, and on the other hand, between 10 and 15 $\mu$Rp;
- each strip is provided with two lugs extending substantially perpendicularly to its plane and cooperating, with two housings provided in the part on which is fixed the said strip, to securing the said strip on the said part;
- said strip is fixed on the cylinder block, whereas the said housings are constituted by circular grooves provided in the faces of the cylinder block and perpendicular to the contact faces of the strips;
- the grooves are co-axial to the axis of rotation;
- the strips have an outer surface made of bronze.

The invention will be more readily understood on reading the following description with reference to the accompanying drawings, in which.

Figure 1:
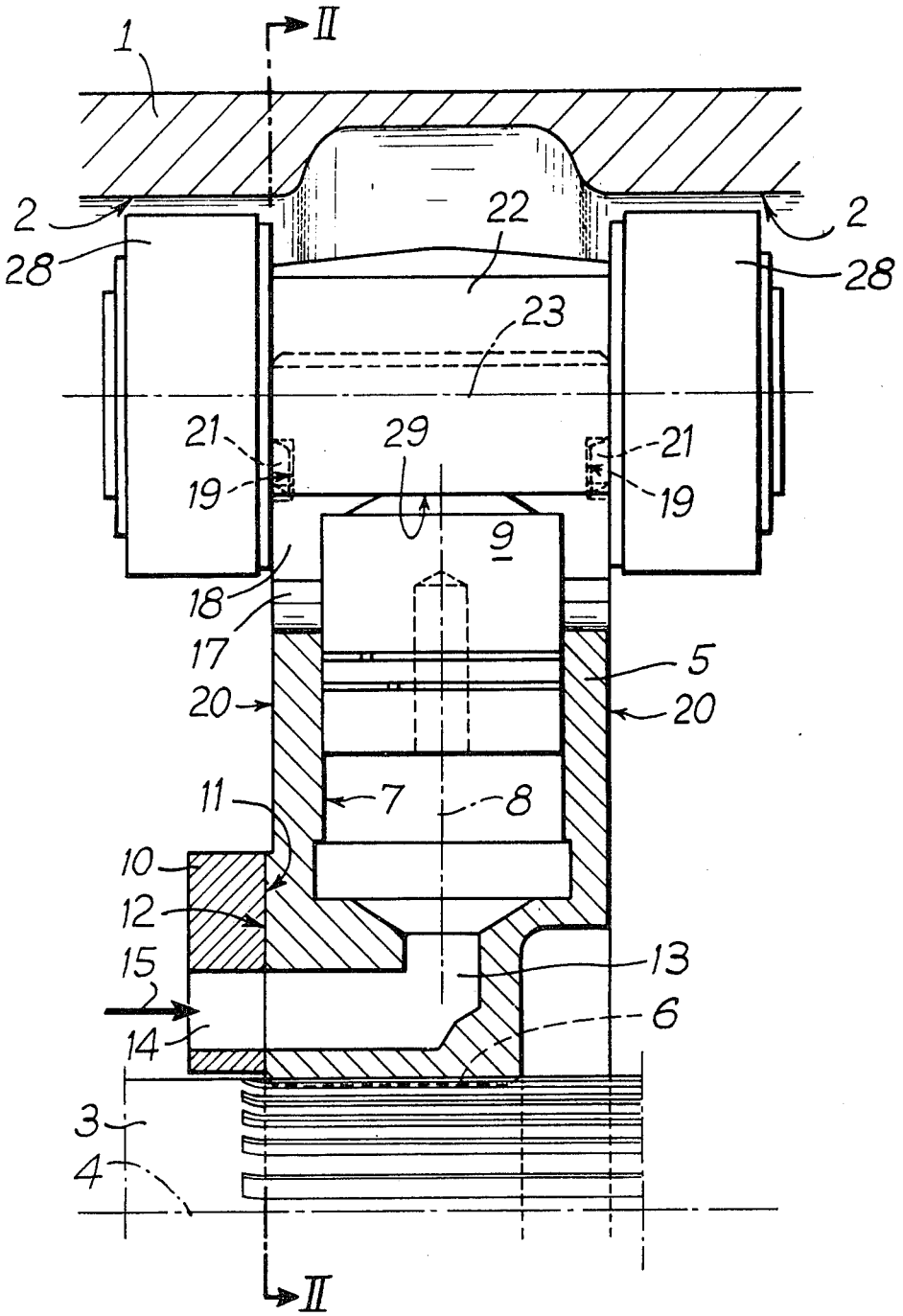
FIG. 1 is an axial cross-section of a hydraulic engine according to the invention.
Figure 2:
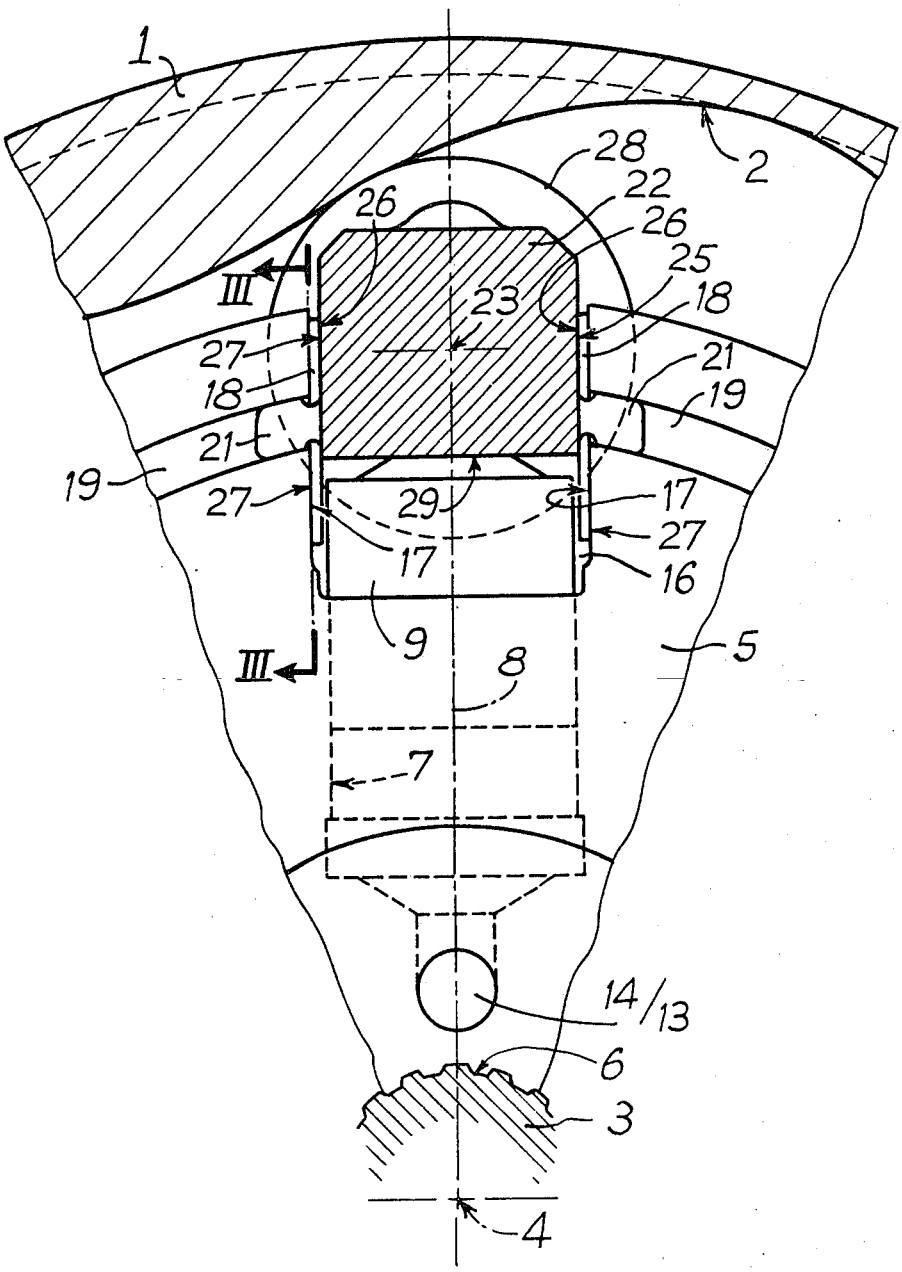
FIG. 2 is a cross-section along II—II of FIG. 1.
Figure 3:
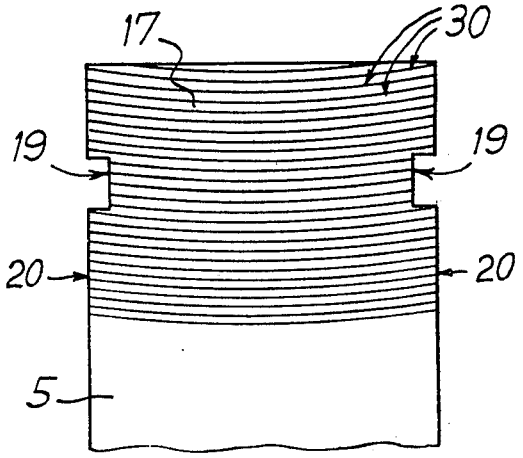
FIG. 3 is a cross-section along III—III of FIG. 2.
Figure 4:
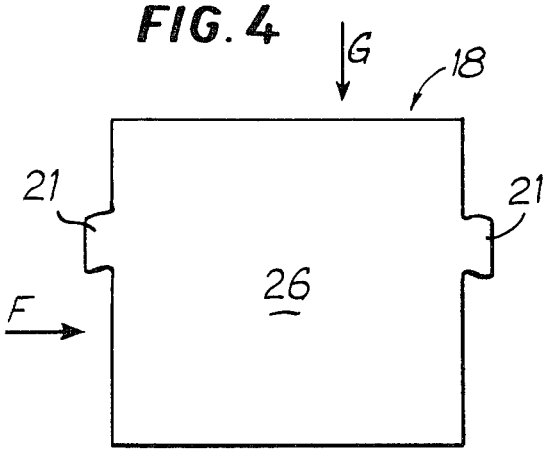
FIG. 4 is an elevational view of one of the strips comprised in the engine shown in FIGS. 1 to 3.
Figure 5:
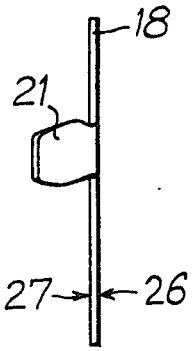
FIG. 5 is a view along arrow F of FIG. 4.
Figure 6:
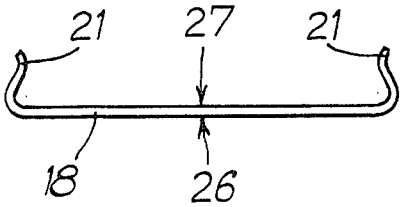
FIG. 6 is a view along arrow G of FIG. 4.

The illustrated hydraulic engine comprises:

- a casing 1,
- a two-way cam 2, integral with the casing 1,
- a driving shaft 3 of rotation axis 4,
- a cylinder block 5, mounted for rotation about the axis 4 whilst being coupled to the shaft 3 by grooves 6,
- cylinders 7, one only being shown in the drawing, which are drilled in the cylinder block 5, the axes of which extend radially with respect to the rotation axis 4, and which cylinders in known manner are distributed regularly in starshaped configuration around the said axis 4,
- pistons 9, mounted for sliding, —one in each cylinder-with respect to the cylinders 7,
- a cylinder port-face 10 for the distribution of the fluid and which, in the illustrated example, presents a plane face 11, resting against a plane face 12 of the cylinder block 5, the said plane faces 11 and 12 being perpendicular to the rotation axis 4, which cylinder port-face is fast in rotation with the cam 2,
- conduits 13, provided in the cylinder block 5, which connect each cylinder 7 to the plane face 12,
- conduits 14, provided in the cylinder port-face 10, which are arranged so as to correspond with openings through which the said conduits issue into the face 12 of the cylinder block, and which, during the relative rotation of the cylinder block 5 with respect to the cylinder port-face 10, are periodically communicating with the conduits 13 of the cylinder block. In known manner, the conduits 14, numbering two, are connected (in 15), one, to a source of pressurized fluid, the other to a discharge reservoir.

It should be noted that a cut 16, defined by two faces 17 parallel to the radial plane of the cylinder, is provided in the cylinder block 5 in extension of the cylinder 7. Each one of the faces 17 of the cut is covered up with a plane strip 18 made of bronze. A groove 19 having been provided on each one of the faces 20 of the cylinder block which are perpendicular to the rotation axis 4, and issuing into each face 17 of each cut 16, each strip 18, which in addition is provided with two lugs 21, the latter extending in perpendicular to the plane of the said strip, is held in position with respect to the cylinder block 7 by introducing the said lugs 21 in the said grooves 19.

A girder 22, substantially parallelepipedic in shape, and with a substantially square cross-section, is situated at least partly inside each cut 16, with, on the one hand, its longitudinal axis 23 parallel to the rotation axis 4, and on the other hand, two (25) of these faces parallel to the faces 17 of the cut and in guiding contact on the faces 26 of the strips 18 which are opposite the faces 27 of the said strips which contact the faces 17 of the cut. Two runners 28 are mounted at the ends of said girder, for rotation about the axis 23 of the girder 22. The piston 9, under the effect of the fluid pressure contained in the cylinder 7, rests against the lower face 29 of the girder 22 and pushes the said girder until the runners 28 are brought in running support on the cam 2.

It should be noted that the surface of one of the faces 17 of the cut presents a special roughness, with the following characteristics, defined in reference with current norms:

at least equal to 0.25 μRa,
at least equal to 15 μRt,
at least equal to 8 μRp, and preferably, at least equal to 0.32 μRa whilst varying between 20 and 30 μRt and between 10 and 15 μRp.

The surface characteristic norms defining the roughness are those as published by 1' Association Francaise De Normalisation (AFNOR)—Tour Europe Cedex 7 92 080 Paris—La Defense.

This particular state of the surface is obtained quite easily when milling the cut 16, by leaving the milling ridges 30 on the faces 17.

Also to be noted is the easy way in which the grooves 19 are obtained, said grooves, being circular and also co-axial to the rotation axis 4, are produced by simply turning the cylinder block 5 around the said rotation axis 4.

The advantages of the arrangements described hereinabove are expressed hereunder.

First of all, the engine works quite normally, with an adequate guiding of the girder inside the cut 16. The sliding of the faces 25 of the girder 22 on the faces 26 of the bronze strips 18 is done with a low coefficient of friction, which is what is required.

But the most remarkable achievement resides in the way the strips 18 are secured in position on the cylinder block. The roughness of the faces 17 of the cut 16 of the cylinder block prevents the formation of any oil films between the faces 27 of each strip 18 and the face 17 of the cut, due to the fact that any oil present can escape between the uneven parts corresponding to the roughness selected. Each plate 18 is thus correctly applied against a face 17 of the cut 16. The lugs 21 are then only required to ensure the control of the position of the corresponding strip 18, without having to withstand any type of strong stresses liable to move the strip 18. Indeed, the firm contact of each strip 18 on the face opposite, cancels out any such efforts to move the strip.

It should also be noted that the invention, instead of trying to make the surface of the faces 17 of the cut 16 perfectly even, has, on the contrary, deliberately chosen to give it a roughness at least equal to certain values, and this is unquestionably an original and non-obvious step.

Also to be noted is the simplicity of the technical operations required:

simple milling of the cuts 16,
simple turning of the grooves 19,
forming the lugs 21 of the strip 18 by simple cutting and folding thereof.

Any tests conducted have confirmed both the efficiency of the solution recommended and its low cost.

The invention is not limited to the embodiment hereinabove described, but on the contrary covers any modifications that could be made thereto without departing from its scope.

What is claimed is:

1. A pressurized hydraulic fluid mechanism comprising:

a cam;
a cylinder block mounted for rotation with respect to the said cam about a rotation axis and including at least one cylinder in said cylinder block;
at least one piston mounted for axial sliding in said cylinder;
a girder operatively coupling said piston to said cam, said girder slidably mounted inside a radial cut formed in said cylinder block, the walls of said cut forming an extension of said cylinder;
said girder positioned adjacent to said walls parallel to the axis of said cylinder;
a removable strip interposed between each wall of the cut and the portion of girder facing it, said strips each fixed on one said wall of the cylinder block or on said girder, the surface of at least one of said wall on which is fixed said strip or the face of said strip which faces said wall having a degree of roughness of at least
0.25 μRa
15 μRt
8 μRp.

2. A mechanism as claimed in claim 1, wherein said roughness is at least equal to 0.32 μRa, between 20 and 30 μRt, and between 10 and 15 μRp.

3. A mechanism as claimed in claim 1 or 2, wherein each strip includes two lugs extending substantially perpendicularly to the plane of said strip and cooperating with two housings provided in the one of said walls or said girder on which is fixed each said strips to secure said strip on the one of said walls or said girder.

4. A mechanism as claimed in claim 3, wherein each of said strips are fixed on said wall of said cylinder block;

said housings comprise circular grooves provided in the faces of said strips.

5. A mechanism as claimed in claim 4, wherein said grooves are co-axial to the axis of rotation.

6. A mechanism as claimed in claim 5, wherein said strips have an outer surface made of bronze.

* * * * *